US007435158B2

(12) United States Patent
Wakaiki et al.

(10) Patent No.: US 7,435,158 B2
(45) Date of Patent: Oct. 14, 2008

(54) INITIAL POSITION SETTING METHOD OF GRINDING WHEEL IN VERTICAL DOUBLE DISC SURFACE GRINDING MACHINE

(75) Inventors: Yoshihiro Wakaiki, Ikeda (JP); Yoshinari Uchida, Suzuka (JP)

(73) Assignees: Daisho Seiki Corporation, Ikeda-shi (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/792,504

(22) PCT Filed: Dec. 10, 2004

(86) PCT No.: PCT/JP2004/018477

§ 371 (c)(1),
(2), (4) Date: Jun. 7, 2007

(87) PCT Pub. No.: WO2006/061910

PCT Pub. Date: Jun. 15, 2006

(65) Prior Publication Data

US 2008/0108280 A1 May 8, 2008

(51) Int. Cl.
*B24B 49/00* (2006.01)

(52) U.S. Cl. ..... 451/9; 451/10; 451/11; 451/41; 451/63; 451/287; 451/262; 451/269

(58) Field of Classification Search ..... 451/5, 451/9, 10, 11, 41, 63, 285, 287, 262, 269
See application file for complete search history.

(56) References Cited

U.S. PATENT DOCUMENTS 3,721,046 A 3/1973 Dunn (Continued)

FOREIGN PATENT DOCUMENTS

JP 47-2195 2/1972

(Continued)

OTHER PUBLICATIONS

International Search Report dated Mar. 22, 2005 with English translation of relevant portion (Four (4) Pages).

*Primary Examiner*—Eileen P. Morgan
(74) *Attorney, Agent, or Firm*—Crowell & Moring LLP

(57) ABSTRACT

The present invention provides an initial position setting method of grinding wheels, before starting a grinding operation, in a vertical double disc surface grinding machine for surface grinding the upper and lower grinding surfaces of a work-piece simultaneously by rotation-driving a pair of grinding wheels by a grinding wheel rotation drive motor and moving the grinding wheels up and down by a grinding wheel vertical drive motor. This method comprises a moving stroke (#1, #4) for rotating the grinding wheels (2, 3) by the grinding wheel rotation drive motors (46), and vertically moving the grinding wheels (2, 3) by the motors for elevating/lowering the grinding wheels (41) toward ground surfaces of the work-piece (W) from a setting-start position (Q1) which is vertically separated away from the ground surfaces of the work-piece (W), a detection stroke (#2, #5) for detecting contacts between the grinding wheels (2, 3) and the ground surfaces of the work-piece (W), and stopping the vertical movement of the grinding wheels (2, 3) based on the detection, and an initial position setting stroke (#3, #6) for vertically moving the grinding wheels (2, 3) by the motors (41)for elevating/lowering the grinding wheels, by a predetermined amount in a direction separating away from the ground surfaces of the work-piece (W).

6 Claims, 4 Drawing Sheets

U.S. PATENT DOCUMENTS

| | | | | |
|---|---|---|---|---|
| 4,827,677 | A * | 5/1989 | Schmitz | 451/11 |
| 5,980,366 | A * | 11/1999 | Waddle et al. | 451/262 |
| 6,881,133 | B2 * | 4/2005 | Saitoh et al. | 451/63 |
| 2006/0194511 | A1 * | 8/2006 | Nagayama et al. | 451/5 |

FOREIGN PATENT DOCUMENTS

| | | | |
|---|---|---|---|
| JP | 4-365548 | A | 12/1992 |
| JP | 2002-307270 | A | 10/2002 |
| JP | 2004-066392 | A | 3/2004 |
| JP | 2004-98197 | A | 4/2004 |

* cited by examiner

INITIAL POSITION SETTING METHOD OF GRINDING WHEEL IN VERTICAL DOUBLE DISC SURFACE GRINDING MACHINE

FIELD OF THE INVENTION

The present invention relates to an initial position setting method of a grinding wheel in vertical double disc surface grinding machine.

BACKGROUND OF THE PRESENT INVENTION

The after mentioned patent document 1 discloses a vertical double disc surface grinding machine in which a pair of vertically opposing grinding wheels is rotated by grinding wheel rotation drive motors and is vertically moved by grinding wheel vertical drive motors, so that surface grindings of upper and lower ground surfaces of a work-piece are carried out simultaneously.

In the case of the grinder of this kind, when a large number of work-pieces are ground continuously, first, the upper and lower grinding wheels are positioned at initial positions which are away from the ground surfaces of the work-piece by a predetermined distance. The initial positions normally are set in the following manner with respect to the first work-piece.

First, the first work-piece is inserted between the upper and lower grinding wheels, and the lower grinding wheel is vertically elevated or lifted by a manual sighting or observation until the lower grinding wheel comes into contact with a lower surface of the work-piece. Next, the upper grinding wheel is lowered by the manual sighting or observation until the upper grinding wheel comes into contact with an upper surface of the work-piece.

Both the grinding wheels are moved away from the positions where they come into contact with the work-piece by the predetermined distance, and these positions are stored or memorized in a controller of the grinder as the initial positions.

In the subsequent grinding operation, when each work-piece is inserted between the upper and lower grinding wheels, the grinding wheels are on standby at the initial positions, and after the work-piece is inserted, the grinding wheels are vertically moved from the initial positions as a starting point, and the grinding operation is carried out.

Patent Document 1: Japanese Unexamined Patent Publication No. 2002-307270

DISCLOSURE OF THE INVENTION

Problems to be Solved by the Invention

In the conventional setting operation of the initial positions of the grinding wheels according to the above mentioned method, the grinding wheels are vertically moved by the manual sighting or observation while manually lightly rotating the grinding wheels, and an operator judges that the grinding wheel comes into contact with a work-piece when the rotation of the grinding wheel becomes heavy or a rubbing sound is coming out. That is, the operator judges that the grinding wheel comes into contact with the work-piece only his or her sense. Therefore, there is a problem that detection of contact is varied among operators and as a result, the initial position of the grinding wheel is also varied.

Further, the grinding wheel is rotated and vertically moved mostly manually. Therefore, there is a problem that an effort of an operator is heavy, it is difficult for one person to carry out the grinding operation, and it takes long time for setting.

It is an object of the present invention to easily set the initial position of the grinding wheel for short time. It is also an object of the invention to make it possible to detect the contact between the work-piece and the grinding wheel without depending upon a sense of an operator, and to precisely set the initial position.

Means for Solving Problems

The invention according to Claim 1 provides an initial position setting method of grinding wheels, before starting a grinding operation, in a vertical type of double disc surface grinding machine for a work-piece in which a pair of vertically opposing upper and lower grinding wheels are rotatably driven by grinding wheel rotation drive motors and vertically driven by grinding wheel vertical drive motors respectively so as to carry out the surface grinding simultaneously on the upper and lower ground surfaces of the work-piece, comprising: a vertical moving stroke in which the grinding wheels are rotatably driven by grinding wheel rotation drive motors and are vertically driven by grinding wheel vertical drive motors so that the grinding wheels move toward the ground surfaces of the work-piece from each setting-start position which is vertically separated away from the ground surfaces of the work-piece, a detection stroke in which contacts between the grinding wheels and the ground surfaces of the work-piece are detected, and the grinding wheels are stopped in the vertical direction on the base of the detections, and an initial position setting stroke in which the grinding wheels are vertically moved in a predetermined amount so that the grinding wheels leave away from the ground surfaces of the work-piece.

The invention according to Claim 2 provides an initial position setting method of grinding wheels, before starting a grinding operation, in a vertical type of double disc surface grinding machine for a work-piece in which a pair of vertically opposing upper and lower grinding wheels is rotatably driven by grinding wheel rotation drive motors and vertically driven by grinding wheel vertical drive motors respectively so as to carry out the surface grinding simultaneously on the upper and lower ground surfaces of the work-piece, comprising: a first vertical moving stroke in which the grinding wheels are rotatably driven by grinding wheel rotation drive motors and are vertically driven by grinding wheel vertical drive motors so that the grinding wheels move toward the ground surfaces of the work-piece from setting-start positions which are vertically separated away from the ground surfaces of the work-piece, a first detection stroke in which a contact between one of the grinding wheels and one of the ground surfaces of the work-piece is detected, and the both grinding wheels are stopped in the vertical direction on the base of the detection, a first initial position setting stroke in which the one of the grinding wheels is vertically moved by a predetermined amount so that the one of the grinding wheels leaves away from the one of ground surface of the work-piece, a second vertical moving stroke in which the other of grinding wheels is moved by the grinding wheel vertical drive motor so that the other of the grinding wheels further moves toward the other of the ground surfaces of the work-piece, a second detection stroke in which a contact between the other of the grinding wheels and the other of the ground surfaces of the work-piece is detected, and the other of the grinding wheels is stopped in the vertical direction on the base of the detection, a second initial position setting stroke in which the other of the grinding wheels is vertically moved by a predetermined amount so that the other of the grinding wheel leaves away from the other of the ground surface of the work-piece.

The invention according to claim 3, in the detection stroke of the invention according to claim 1 or 2, a current value of the grinding wheel rotation drive motor is increased by a predetermined amount from a value of a state where there is no load, thereby detecting the contact between the grinding wheel and the ground surface of the work-piece.

The invention according to claim 4, in the invention according to claim 3, the amount of increase of the current value of the grinding wheel rotation drive motor from the value of the state where there is no load is set smaller than an amount of increase of a current value from the state where there is no load when the work-piece is ground.

The invention according to claim 5, in the vertical moving stroke of the invention according to claim 1 or 2, the maximum moving amount of the grinding wheel toward the ground surface of the work-piece from a setting-start position is limited to a predetermined value.

The invention according to claim 6, in the moving stroke of the invention according to claim 1 or 2, a vertical moving speed of the grinding wheel toward the ground surface of the work-piece from a setting-start position is set faster than a vertical moving speed of the grinding wheel when a work-piece is ground.

The invention according to claim 7, in the moving stroke of the invention according to claim 1 or 2, a moving speed of the grinding wheel toward the ground surface of the work-piece from the setting-start position is set faster than a moving speed of the grinding wheel when a work-piece is ground, and the maximum moving amount of the grinding wheel toward the ground surface of the work-piece from the setting-start position is limited to a predetermined value.

EFFECT OF THE INVENTION

According to the invention of claim 1, when the initial position of the grinding wheel is to be set, the grinding wheel is rotated and vertically moved automatically by the grinding wheel rotation drive motor and the grinding wheel vertical drive motor. Thus, effort of an operator can be reduced, and the setting operation can easily be carried out for short time.

According to the invention of claim 2, when the initial position of the grinding wheel is to be set, the grinding wheel is rotated and vertically moved automatically by the grinding wheel rotation drive motor and the grinding wheel vertical drive motor. Thus, effort of an operator can be reduced, and the setting operation of the grinding wheel can easily be carried out for short time. The upper and lower grinding wheels do not come into contact with the work-piece simultaneously almost at all, this prevents the contact position of the other grinding wheel from being deviated due to a bend of the work-piece by a contact with one of the grinding wheels, and it is possible to precisely detect the contact between the work-piece and the grinding wheel.

According to the invention of claim 3, the contact of the grinding wheel with the work-piece can automatically be detected by increase in the current value of the grinding wheel rotation drive motor, and detection is not varied among operators. Thus, it is possible to precisely set the initial position.

According to the invention of claim 4, when the contact of the grinding wheel with the work-piece is to be detected, the grinding wheel does not excessively grind the work-piece, and the detection sensitivity can be enhanced.

According to the invention of claim 5, it is possible to prevent a work-piece from being excessively ground by the grinding wheel and to prevent the work-piece from being damaged by collision against the grinding wheel.

According to the invention of claim 6, it is possible to swiftly set the initial position.

According to the invention of claim 7, the vertical moving speed of the grinding wheel is set faster than that at the time the grinding operation. With this, it is possible to set the initial position swiftly, and even if the vertical moving speed is fast, since the maximum moving amount is limited, it is possible to prevent a work-piece from being excessively ground by the grinding wheel and to prevent the work-piece from being damaged by collision against the grinding wheel.

BEST MODE FOR CARRYING OUT THE INVENTION

[Entire Structure of Vertical Double Disc Surface Grinding Machine]

Figure 1:
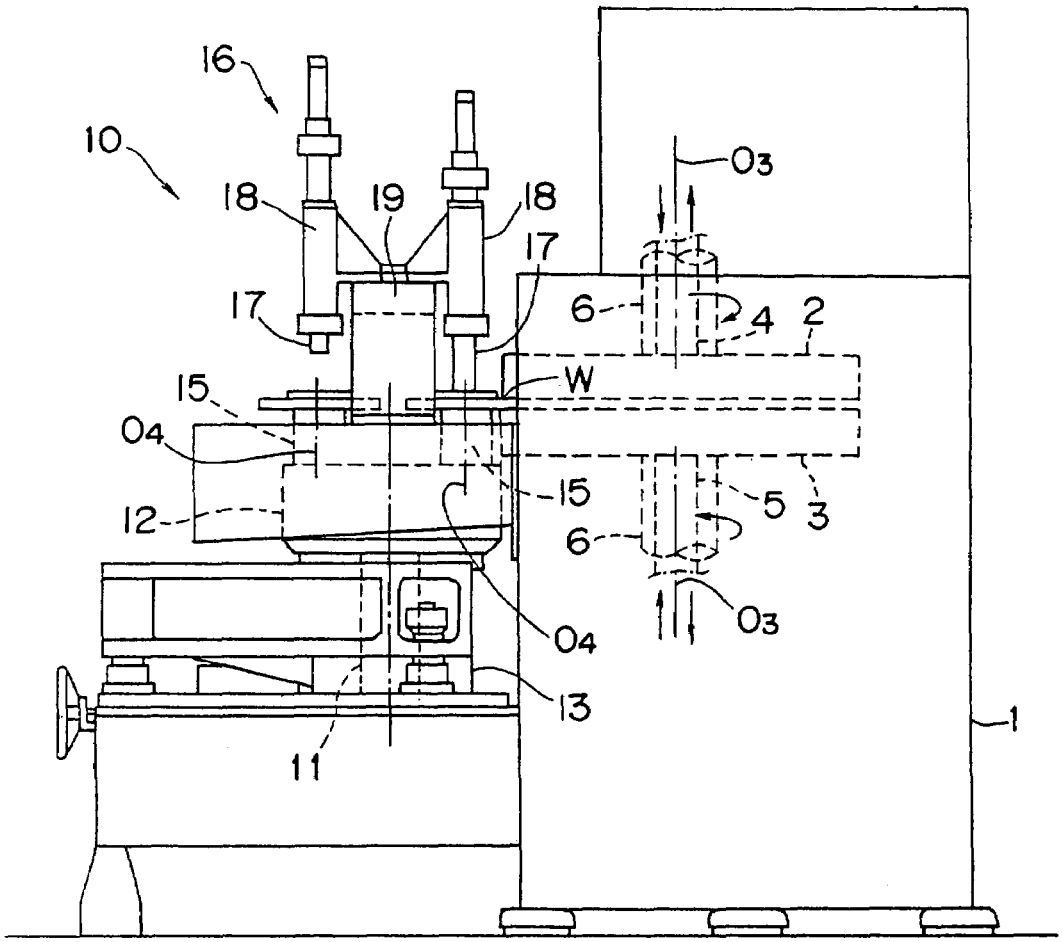
FIG. 1 is a side view of a vertical double disc surface grinding machine to which the present invention is applied.

FIG. 1 is a side view of a vertical double disc surface grinding machine to which the present invention is applied. A pair of vertically opposing annular grinding wheels 2 and 3 is accommodated in a body case 1. The upper and lower grinding wheels 2 and 3 are respectively fixed to upper and lower grinding wheel shafts 4 and 5 which are disposed on the same vertical axis O3. The grinding wheel shafts 4 and 5 are supported by upper and lower slide cylinders 6 and 6 such that the grinding wheel shafts 4 and 5 can rotate and integrally move vertically.

A work-piece supply device 10 is disposed in adjacent to the body case 1. The work-piece supply device 10 includes a rotation table 12 which is fixed to an upper end of a vertical table drive shaft 11. The table drive shaft 11 is rotatably supported by a support case 13 through a bearing, and is connected to a drive motor (not shown).

A pair of work-piece fixing jigs 15 and 15 and a clamp device 16 which presses a work-piece W from above are provided on the rotation table 12.

The clamp device 16 includes a pair of cylinders 18 and 18 each having a clamp rod 17. The clamp rod 17 can expand downward. Each cylinder 18 is disposed on the same axis as a rotation axis O4 of the work-piece fixing jig 15, and is fixed to a bracket 19 which is fixed to an upper surface of the rotation table 12. The clamp rod 17 is lowered to press the work-piece W on the work-piece fixing jig 15, and the clamp rod 17 can rotate around the axis O4 of the work-piece fixing jig 15 with the work-piece W in a state that the work-piece W is pressed.

Figure 2:
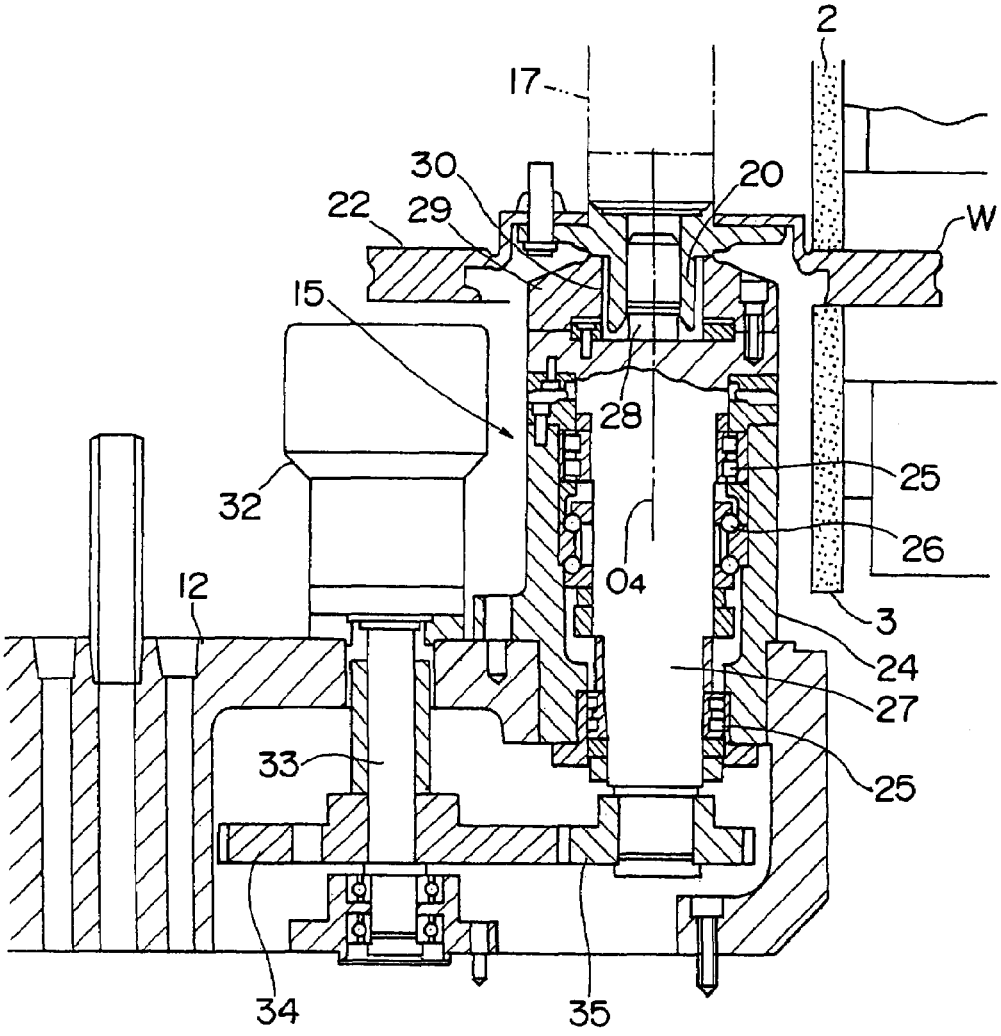
FIG. 2 is a side sectional view of a work-piece fixing jig.

FIG. 2 is a side sectional view of the work-piece fixing jig. The work-piece W is a vehicular brake disk for example, and the work-piece W composes of a hub 20 and an annular disk 22 fixed to an upper end flange of the hub 20.

The work-piece fixing jig 15 has a cylindrical jig body 24 which is vertically fixed to an upper wall of the rotation table 12, and a rotation shaft 27 which is supported in the jig body 24 through bearings 25 and 26 such that the rotation shaft 27 can rotate but can not move in the axial direction. A positioning pin 28 stands on an upper end surface of the rotation shaft 27. The positioning pin 28 projects upward on the same axis as that of the fixing jig 15. An annular work-piece mounting stage 29 is fixed to the upper end surface of the rotation shaft 27. The annular work-piece mounting stage 29 has a center hole 30 in which a hub 20 of the work-piece W can be inserted. The diameter of the positioning pin 28 is set such that the hub 20 of the work-piece W can be fitted into the positioning pin 28.

An electric rotate motor 32 for rotating the work-piece is mounted on the rotation table 12 at a location closer to the center of the table than the work-piece fixing jig 15. Reduction gears 34 and 35 are provided on a motor shaft 33 of the electric motor 32 and a lower end of the rotation shaft 27, respectively. The reduction gears 34 and 35 mesh with each other in the rotation table 12. The rotation shaft 27 of the work-piece fixing jig 15 is rotated by rotation of the electric motor 32. With this, a work-piece W fixed to the annular work-piece mounting stage 29 through the clamp rod 17 is rotated around the axis of the work-piece fixing jig 15.

[Grinding Wheel Vertical Moving Mechanism and Grinding Wheel Rotating Mechanism]

Figure 3:
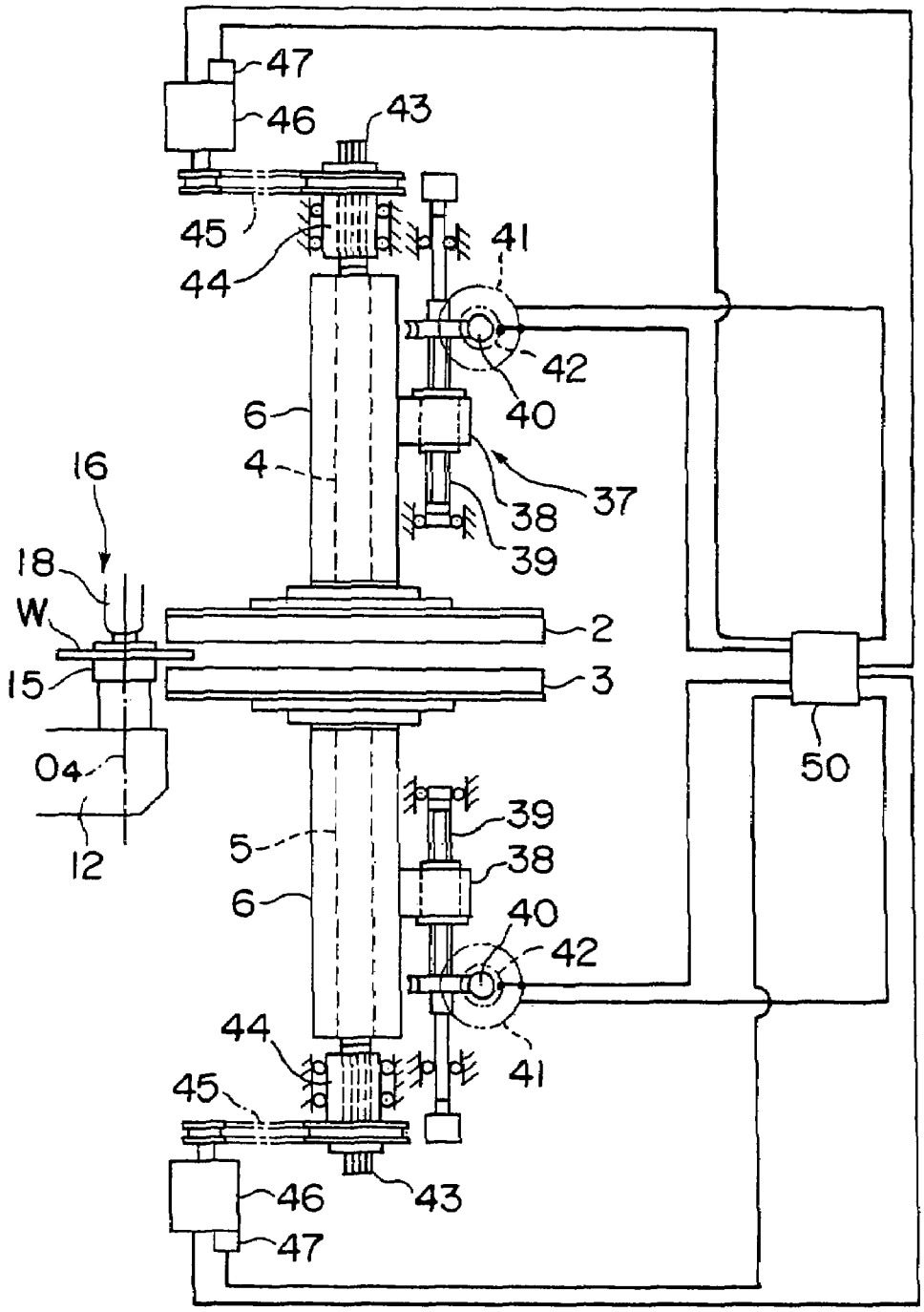
FIG. 3 is a schematic side view of one example of a grinding wheel elevating/lowering mechanism, a grinding wheel rotating mechanism and control mechanisms thereof.

FIG. 3 is a schematic side view showing one example of a grinding wheel vertical moving mechanism, a grinding wheel rotating mechanism and control mechanisms thereof. The upper grinding wheel shaft 4 is supported in the upper slide cylinders 6 through bearings such that the upper grinding wheel shaft 4 can rotate. The upper grinding wheel shaft 4 can integrally move with the upper slide cylinders 6 in the vertical direction. The upper slide cylinder 6 is fixed to a travel nut 38 of a ball screw mechanism 37. The travel nut 38 is screw engaged with a vertical feed screw 39 through balls such that the travel nut 38 can vertically move. The feed screw 39 is connected to an AC servo motor for vertically moving the upper grinding wheel 41 through a worm gear mechanism 40. Therefore, when the AC servo motor for elevating the grinding wheel 41 rotates, the upper grinding wheel shaft 4 and the upper grinding wheel 2 vertically move together with the upper slide cylinders 6 through the worm gear mechanism 40 and the ball screw mechanism 37.

A rotary encoder 42 is connected to the upper AC servo grinding wheel vertical drive motor 41. The rotary encoder 42 detects a rotation angle of the upper AC servo grinding wheel vertical drive motor 41, thereby detecting a vertical position and a vertical moving amount of the upper grinding wheel 2.

A spline portion 43 is formed on an upper end of the upper grinding wheel shaft 4. The spline portion 43 is spline-fitted into a sprocket 44 such that the spline portion 43 can slide in the vertical direction. The sprocket 44 is provided at its inner periphery with splines. The sprocket 44 is connected to the motor 46 for rotating the upper grinding wheel 2 through a belt drive mechanism 45. Therefore, if the grinding wheel rotating motor 46 rotates, the upper grinding wheel shaft 4 and the upper grinding wheel 2 are rotated through the belt drive mechanism 45, the sprocket 44 and the spline fitting portion, and the upper grinding wheel shaft 4 and the upper grinding wheel 2 are allowed to move vertically. The motor 46 for rotating the upper grinding wheel 2 is provided with an upper current detector 47 which measures a value of current flowing through the grinding wheel rotating motor 46 so as to detect a contact position of the upper grinding wheel 2 with respect to the work-piece W.

The grinding wheel vertical moving mechanism and the grinding wheel rotating mechanism of the lower grinding wheel shaft 5 are only vertically symmetric to the grinding wheel vertical mechanism and the grinding wheel rotating mechanism of the upper grinding wheel shaft 4, and basic structures thereof are the same, and the same elements are designated with the same symbols.

In order to independently control ON and OFF operations, switching operation between normal rotation and reverse rotation, and rotation speed of the motors for upper and lower of the AC servo grinding wheel vertical drive motors 41 and the grinding wheel and electric motors 46, the motors 41 and 46 are connected with a controller 50 having a microcomputer and a memory therein, and the upper and lower current detectors 47 and 47 and the upper and lower rotary encoders 42 and 42 are connected with an input section of the controller 50. Whereby, current values of the grinding wheel rotating motors 46 and 46 detected by the current detectors 47 and 47, and a rotation angle detection signal of the AC servo grinding wheel vertical drive motors 41 and 41 detected by the rotary encoders 42 and 42 are input to the input section.

A vertical position and a vertically moving amount of each of the upper and lower grinding wheels 2 and 3 are calculated in the controller 50 by the rotation angle and the number of revolutions of the AC servo grinding wheel vertical drive motor 41 detected by the rotary encoder 42. When a current value which is input from each current detector 47 is increased by a predetermined value (e.g., 1 to 1.5 amperes) from a value at the time of rotation with no load (e.g., 20 to 30 amperes), it is determined that the grinding wheels 2 and 3 reach the grinding-start positions, and a moving amount from each of the grinding-start positions is measured by the rotary encoder 42 as a grinding amount (predetermined margin).

[Initial Position Setting Operation of Grinding Wheel]

Figure 4:
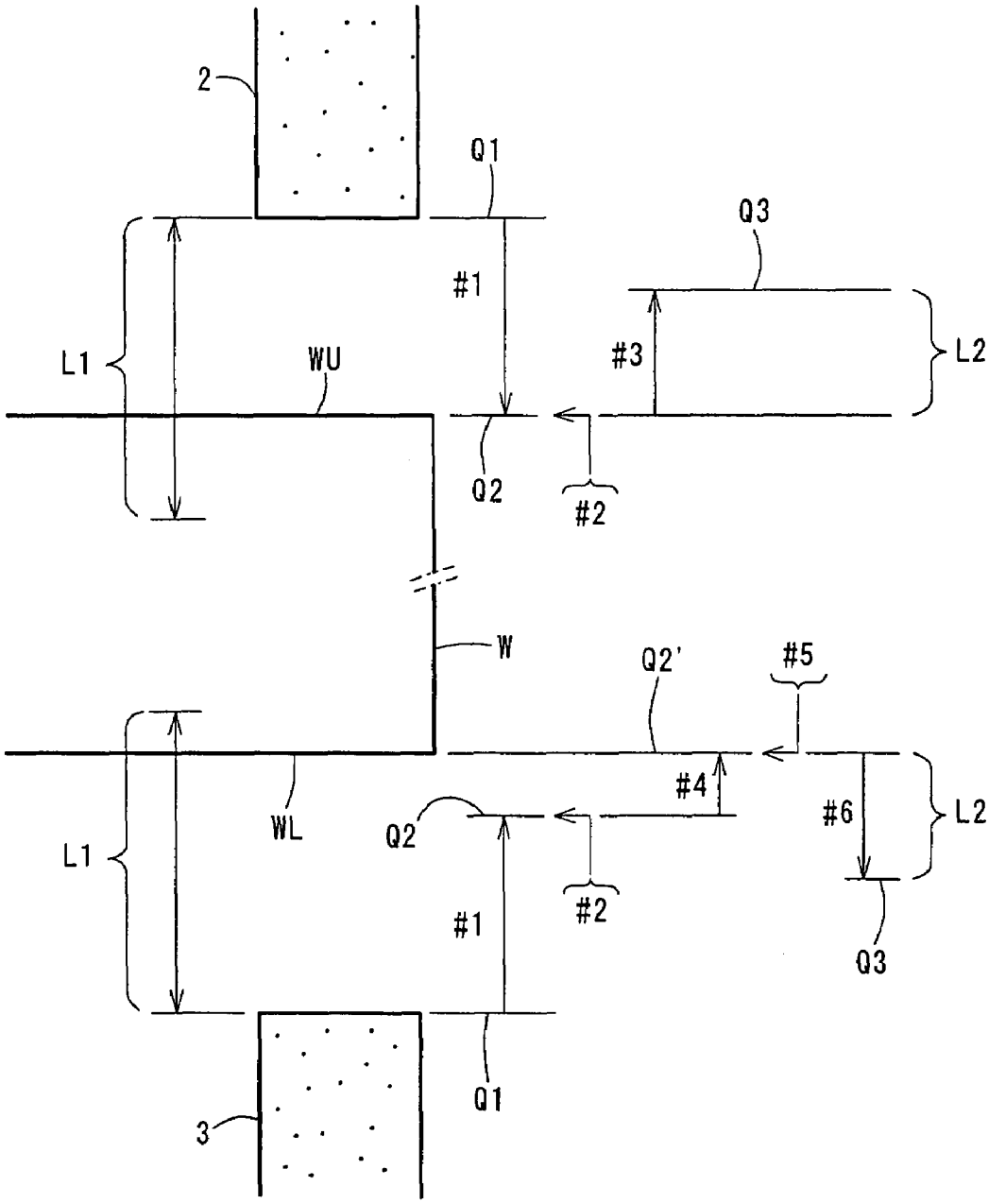
FIG. 4 is an explanatory diagram showing motion of the grinding wheel when the initial position of the grinding wheel is set.

Next, before starting the grinding operation, operation for setting the initial positions of the grinding wheels 2 and 3 will be explained. FIG. 4 shows motion of the grinding wheels when the initial positions thereof are set.

When a large number of work-pieces W are continuously ground, the initial position of the grinding wheels 2 and 3 are also standby positions of the grinding wheels 2 and 3 when the work-piece W is inserted between the upper and lower grinding wheels 2 and 3. The setting operation of the initial positions is usually carried out one time before the first work-piece W is ground.

Before the initial position setting operation is carried out, the first work-piece W is mounted on the work-piece fixing jig 15, and the work-piece W is inserted between the upper and lower grinding wheels 2 and 3. The upper and lower grinding wheels 2 and 3 are vertically moved close to setting-start positions Q1 using the manual sighting or observation.

The setting-start positions Q1 are set such that distances between the upper and lower grinding wheels 2 and 3 and upper and lower ground surfaces WU and WL fall within a predetermined distance L1. This distance L1 is the maximum moving distances of the grinding wheels 2 and 3 when the initial position is set. The distance L1 can be varied and set in an after mentioned data setting operation.

Stroke #1 in FIG. 4 is a step for vertically moving the upper and lower grinding wheels 2 and 3 from the setting-start position Q1 toward the work-piece W at the same time by the AC servo grinding wheel vertical drive motors 41 (FIG. 3) (moving stroke #1). At that time, the upper and lower grinding wheels 2 and 3 are rotated by the grinding wheel rotation drive motors 46 (FIG. 3), and cooling water is supplied at the same time. The work-piece W is also rotated by the electric motor 32 (FIG. 2).

If one of the upper and lower grinding wheels first comes into contact with the work-piece W, this contact is detected and the vertical motion of both the grinding wheels 2 and 3 is stopped (detection stroke #2). In FIG. 4, the upper grinding wheel 2 first comes into contact with the ground surface WU of the work-piece W, and the lower grinding wheel 3 does not reach the ground surface WL of the work-piece W. In FIG. 4, Q2 represents stop positions (contact position of the upper grinding wheel 2) of the upper and lower grinding wheels 2 and 3.

Thereafter, in stroke #3, the upper grinding wheel 2 is vertically moved away from the work-piece W toward the initial position Q3 (initial position setting stroke #3). The initial position Q3 is a position away from the position Q2 where the grinding wheel 2 comes into contact with the work-piece W by a predetermined distance L2 (e.g., 1.5 mm). This initial position Q3 is stored in the controller 50 (FIG. 3). During this stroke #3, the vertical motion of the lower grinding wheel 3 is stopped.

After the upper grinding wheel 2 is positioned at the initial position Q3, in stroke #4, the lower grinding wheel 3 is further moved vertically toward the work-piece W (moving stroke #4). If the lower grinding wheel 3 comes into contact with the work-piece W, this contact is detected, and the vertical motion of the lower grinding wheel 3 is stopped (detection stroke #5). In the drawing, Q2' represents a stop position of the lower grinding wheel 3 (contact position of the lower grinding wheel 3).

Then, in stroke #6, the lower grinding wheel 3 is vertically moved away from the work-piece W toward the initial position Q3 (initial position setting stroke #6). The position Q3 is stored or memorized in the controller 50.

The initial position setting operation of the grinding wheels 2 and 3 is completed, and the grinding operation can now be started.

In the setting operation, since the grinding wheels 2 and 3 are vertically moved by the AC servo grinding wheel vertical drive motors 41, the vertically moving operation of the grinding wheel by a user using the manual sighting or observation becomes unnecessary unlike the conventional technique. Since the grinding wheels 2 and 3 are rotated by the grinding wheel rotation drive motors 46, the manual rotating operation of the grinding wheel by a user becomes unnecessary. Efforts of an operation can be reduced, and the setting operation can easily be carried out.

In the detection strokes #2 and "5, the contacts of the grinding wheels 2 and 3 with respect to the work-piece W are detected in the following manner. That is, as shown in FIG. 3, during the initial position setting operation, a current value of each grinding wheel rotation drive motor 46 is always measured by each current detector 47, and increase in-the current value when the grinding wheels 2 or 3 come into contact with the work-piece W and a load is applied is monitored in the controller 50. If the amount of increase reaches a predetermined value, it is determined that the grinding wheels 2 or 3 come into contact with the work-piece W, and the AC servo grinding wheel rotation drive motor 46 is stopped.

Therefore, the contacts of the grinding wheels 2 and 3 with respect to the work-piece W are automatically detected based on the variation of the current value of the grinding wheel rotation drive motors 46 rather than based on a sense of an operator. Therefore, variation is not caused among operators, and the contact can precisely be detected.

Next, setting of data concerning the setting of initial position will be explained. The data setting operation is carried out before the initial position setting operation. For example, a data setting screen is shown in a display unit of the grinder, and an amount of increase in the current values of the upper and lower grinding wheel rotating motors 46 when the upper and lower grinding wheels 2 and 3 come into contact with the work-piece W, the maximum moving amounts L1 of the grinding wheels 2 and 3 when the initial position is set, and vertical moving speeds of the grinding wheels 2 and 3 are set.

Concerning a set value of each data, the amount of increase of the current value can be set to 0.5 A, the maximum moving amount L1 of the grinding wheel can be set to 5 mm, and the moving speed of the grinding wheel can be set to 100 to 200 μm/s.

The amount of increase of the current value when the grinding wheels 2 and 3 come into contact with the work-piece W is preferably set to a value smaller than an amount of increase of a current value when the grinding operation is carried out (e.g., 1 to 1.5 A). With this, the contacts of the grinding wheels 2 and 3 with the work-piece W can be detected with high sensitivity without grinding the work-piece W almost at all.

When the setting operation of the initial position is carried out, it is possible to prevent the grinding wheels 2 and 3 from excessively grinding the work-piece W by limiting the maximum moving amounts L1 of the grinding wheels 2 and 3 to predetermined values.

When the maximum moving amount L1 is set to 5 mm, the setting-start positions Q1 should be set to a position separated away from the ground surfaces WU and WL by a distance not greater than 5 mm, e.g., by a distance between 2 to 3 mm. With this, when the initial position is to be set, the grinding wheels 2 and 3 absolutely come into contact with the work-piece W, and an error which used to be caused due to non-contact can be prevented. The position of the setting-start positions Q1 is satisfied only if the distances from the ground surfaces WU and WL are within the range of 5 mm, and the distances need not be quite the same. Therefore, an operator can easily and manually set the setting-start position without the need of technique or skill.

It is preferable that the vertical moving speeds of the grinding wheels 2 and 3 are set to values (100 to 200 μm/s) higher than the vertical moving speed of a general grinding operation (e.g., 5 to 20 μm/s). With this, the initial position setting operation can be carried out swiftly. Even if the vertical moving speed is increased, since the vertical moving amount is limited to the predetermined value L1, the work-piece W is not ground excessively due to momentum, and it is possible to prevent the work-piece W and the grinding wheels 2 and 3 from being damaged.

In strokes #2 and #5, when the upper grinding wheel 2 comes into contact with the work-piece W, the vertical motion of both the upper and lower grinding wheels 2 and 3 is stopped, the upper grinding wheel 2 is first moved to the initial position Q3 and separated from the work-piece W and then, the lower grinding wheel 3 comes into contact with the work-piece W. With this, both the upper and lower grinding wheels 2 and 3 do not come into contact with the work-piece W at the same time. This prevents the contact position of the other grinding wheel becomes incorrect due to a bend of the work-piece by contact with one of the grinding wheels.

The present invention is not limited to the embodiments, and the design can appropriately be changed. For example, in FIG. 4, stroke #3 of the upper grinding wheel 2 may be carried out simultaneously with stroke #6 after strokes #4 and #5 of the lower grinding wheel 3 are ended. Further, stroke #3 of the upper grinding wheel 2 and stroke #4 and subsequent strokes of the lower grinding wheel 3 may be carried out at the same time. In such cases, the lower grinding wheel 3 may continuously be moved to the position Q2' without stopping the lower grinding wheel 3 at the position Q2.

INDUSTRIAL APPLICABILITY

When a large number of work-pieces W are continuously ground by a vertical double disc surface grinding machine, the present invention can effectively be utilized as a preliminary operation.

The invention claimed is:

1. An initial position setting method of grinding wheels, before starting a grinding operation, in a vertical type of double disc surface grinding machine for a work-piece in which a pair of vertically opposing upper and lower grinding wheels are rotatably driven by grinding wheel rotation drive motors and vertically driven by grinding wheel vertical drive motors respectively so as to carry out the surface grinding simultaneously on the upper and lower ground surfaces of the work-piece; the method comprising:

a first vertical moving stroke in which the grinding wheels are rotatably driven by grinding wheel rotation drive motors and are vertically driven by grinding wheel vertical drive motors so that the grinding wheels move toward the ground surfaces of the work-piece from setting-start positions which are vertically separated away from the ground surfaces of the work-piece, a first detection stroke in which a contact between a first grinding wheel and a first ground surface of the work-piece is detected, and the grinding wheels are stopped in the vertical direction on the basis of the detection, a first initial position setting stroke in which the first grinding wheel is vertically moved by a predetermined amount so that the first grinding wheel moves away from the first ground surface of the work-piece, while the second grinding wheel remains at stopped position in the vertical direction, a second vertical moving stroke in which the second grinding wheel is moved by the grinding wheel vertical drive motor so that the second grinding wheel further moves toward the second ground surface of the work-piece, a second detection stroke in which a contact between the second grinding wheel and the second ground surface of the work-piece is detected, and the second grinding wheel is stopped in the vertical direction on the basis of the detection and, a second initial position setting stroke in which the second grinding wheel is vertically moved by a predetermined amount so that the second grinding wheel moves away from the second ground surface of the work-piece.

2. The initial position setting method of the grinding wheels in the vertical double disc surface grinding machine according to claim 1, wherein in the detection stroke, a current value of the grinding wheel rotation drive motor is increased by a predetermined amount from a value of a state where there is no load, thereby detecting the contact between the grinding wheel and the ground surface of the work-piece.

3. The initial position setting method of the grinding wheels in the vertical double disc surface grinding machine according to claim 2, wherein the amount of increase of the current value of the grinding wheel rotation drive motor from the value of the state where there is no load is set smaller than an amount of increase of a current value from the state where there is no load when the work-piece is ground.

4. The initial position setting method of the grinding wheels in the vertical double disc surface grinding machine according to claim 1, wherein in the vertical moving stroke, the maximum moving amount of the grinding wheel toward the ground surface of the work-piece from a setting-start position is limited to a predetermined value.

5. The initial position setting method of the grinding wheels in the vertical double disc surface grinding machine according to claim 1, wherein in the vertical moving stroke, a moving speed of the grindind wheel toward the ground surface of the work-piece from the setting-start position is set faster than a moving speed of the grinding wheel when a work-piece is ground.

6. The initial position setting method of the grinding wheels in the vertical double disc surface grinding machine according to claim 1, wherein in the vertical moving stroke, a moving speed of the grinding wheel toward the ground surface of the work-piece from the setting-start position is set faster than a moving speed of the grinding wheel when a work-piece is ground, and the maximum moving amount of the grinding wheel toward the ground surface of the work-piece from the setting-start position is limited to a predetermined value.

* * * * *